United States Patent [19]

Northrop et al.

[11] Patent Number: 4,924,368

[45] Date of Patent: May 8, 1990

[54] FLUORESCENT LAMP WITH PROTECTIVE SHIELD

[75] Inventors: Donald P. Northrop, Glen Rock; David P. Strauss, Ridgefield, both of N.J.

[73] Assignee: Duro-Test Corporation, North Bergen, N.J.

[21] Appl. No.: 295,043

[22] Filed: Jan. 6, 1989

[51] Int. Cl.[5] ..... F21V 15/00

[52] U.S. Cl. ..... 362/376; 362/260; 362/223; 313/110

[58] Field of Search ..... 362/217, 260, 376, 377, 362/378, 223; 313/512, 110

[56] References Cited

U.S. PATENT DOCUMENTS

| | | | |
|---|---|---|---|
| 2,366,216 | 11/1945 | Roberts | 362/256 |
| 3,602,759 | 8/1971 | Evans | 313/486 |
| 3,673,401 | 6/1972 | Du Pont | 362/377 |
| 3,808,495 | 4/1974 | Win | 362/223 |

FOREIGN PATENT DOCUMENTS

| | | | |
|---|---|---|---|
| 3337083 | 5/1984 | Fed. Rep. of Germany | 362/225 |
| 1347231 | 11/1963 | France | 362/223 |
| 0035280 | 4/1978 | Japan | 362/223 |
| 670824 | 4/1952 | United Kingdom | 362/223 |

*Primary Examiner*—Ira S. Lazarus
*Assistant Examiner*—D. M. Cox
*Attorney, Agent, or Firm*—Darby & Darby

[57] ABSTRACT

A shatter-containment fluorescent lamp having a protective plastic sleeve in which the sleeve is attached by an adhesive at each end of the lamp envelope in a manner to provide a controlled air space between the glass lamp envelope and the plastic sleeve to prevent direct transmission of stresses from the envelope to the sleeve. The sleeve is also attached to the lamp base by the adhesive so that there is integral connection of the sleeve and the base at each end of the envelope. A retaining ring, also held by the adhesive, covers the base. In a preferred embodiment of the invention, the retaining ring inner surface and the lamp base having mating members to align the retaining ring on the base. In another embodiment, the sleeve has a number of angled slots around its circumference at each end and there are corresponding locking teeth on a retaining ring to accommodate for variations in lamp envelope/protective sleeve length.

16 Claims, 3 Drawing Sheets

FLUORESCENT LAMP WITH PROTECTIVE SHIELD

BACKGROUND OF THE INVENTION

Fluorescent lamps are, of course, widely used. Such lamps are subject to breakage, particularly when used in rough service environments.

Heretofore, protective plastic coatings or plastic sleeves have been used to protect fluorescent lamps, often to take care of the use of such lamps in low temperature environments. A protective sleeve or coating has another advantage in that if the lamp is struck or dropped so that its envelope shatters, then the protective sleeve can act to prevent the imploding and scattering of the broken glass and the internal components of the lamp, such as mercury, from entering into the environment.

In U.S. Pat. No. 4,506,189 to Nolan et al granted Mar. 19, 1985, a polymeric coating is deposited over the length of the envelope and a portion of the lamp end caps, or terminal base, at each end of the envelope to retain the broken glass and hold the end caps attached to the coating and to the glass surrounding the end caps. In this arrangement, the coating is in direct contact with the glass envelope along its length. Thus, any thermal or mechanical stresses which affect the envelope are also present on the coating.

In U.S. Pat. No. 3,673,401, a protective sleeve for a fluorescent lamp is shown in which an expansible sleeve is held at each end of the fluorescent lamp envelope by a retaining ring. The sleeve inner diameter is larger than the envelope outer diameter so that it is spaced a distance from the envelope. This minimizes the transmission of thermal and mechanical stresses between the envelope and sleeve. The sleeve is expansible so that if the lamp envelope ruptures the sleeve will collapse to accomodate the air rushing into the sleeve to compensate for the low pressure in the envelope and then expand back to its normal shape. Also, the components of this assembly are not assembled to form a substantially unitary structure. Therefore, if the envelope breaks, the retaining rings possibly can detach from the envelope and the broken envelope pieces can spill out of the sleeve.

BRIEF DESCRIPTION OF THE SUBJECT INVENTION

The present invention is directed to a fluorescent lamp with a protective plastic sleeve and an arrangement for attaching the sleeve to the lamp such that there is a complete encasement of all the lamp parts and its internal components. In accordance with the invention, a plastic protective sleeve having a somewhat larger inner diameter than the outer diameter of the envelope fits over the lamp envelope. Each end of the sleeve is coupled to a lamp base (end cap) which carries the lamp terminals in a manner such that the coupling is maintained if the envelope breaks. An amount of adhesive is applied to the lamp base to either hold the sleeve end directly or to hold a retaining ring to which the end of the sleeve is coupled or to hold both the retaining ring and the end of the sleeve. The sleeve is strong enough to withstand the rupture of the envelope and the change of pressure due to envelope implosion. Upon breakage of the lamp envelope, both the glass and the lamp components are contained within the sleeve to which the lamp base stays attached. In addition, there is a controlled air space between the lamp's glass envelope and the sleeve so that mechanical stresses, such as of the breaking glass of the envelope, are not applied directly to the sleeve.

In a preferred embodiment of the invention, the retaining ring is assembled to the lamp base by using an aligning tab on the inner surface which mates with the indent on the lamp base which is used to usually indicate the lamp orientation to a person controlling the lamp in a fixture. The retaining ring has an indent on its outer surface to preserve the orientation feature of the lamp.

Another embodiment of the invention, each end of the sleeve has a plurality of angled slots around its circumference and the retaining ring has a plurality of internal locking teeth which fit into the slots. For this arrangement, the retaining ring can be adjusted to compensate for any variations in length of the lamp envelope or sleeve or any misalignments of the lamp base. In all embodiments of the invention, it is preferred that the outer surface of the retaining ring is chamfered to permit the lamp to be easily mounted into the lamp socket.

OBJECTS OF THE INVENTION

It is therefore an object of the invention to provide a protective sleeve for a fluorescent lamp.

A further object is to provide a protective sleeve for a fluorescent lamp which is permanently fastened to the base at the end of the envelope while having an air space between the sleeve and the envelope.

Yet another object is to provide a protective sleeve for a fluorescent lamp in which the sleeve is mounted so as to have a permanent connection between the sleeve and the lamp base while leaving an air space between the sleeve and the envelope.

An additional object is to provide a protective sleeve for a fluorescent lamp in which an adhesive attaches each end of the sleeve to the lamp base and to the envelope with the adhesive being covered by and adhered to a retaining ring.

Another object is to provide a protective sleeve for a fluorescent lamp in which the ends of the sleeve are permanently affixed by adhesive to the base at each end of the lamp and a retaining ring for containing the parts of the lamp within the sleeve in case of breakage.

Still another object is to provide a protective sleeve for a fluorescent lamp arrangement so that the containment of all lamp parts upon breakage can be achieved without increasing the overall lamp length.

BRIEF DESCRIPTION OF THE DRAWINGS

Other objects and advantages of the present invention will become more apparent upon reference to the following specification and annexed drawings in which.

DETAILED DESCRIPTION OF THE INVENTION

Figure 1:
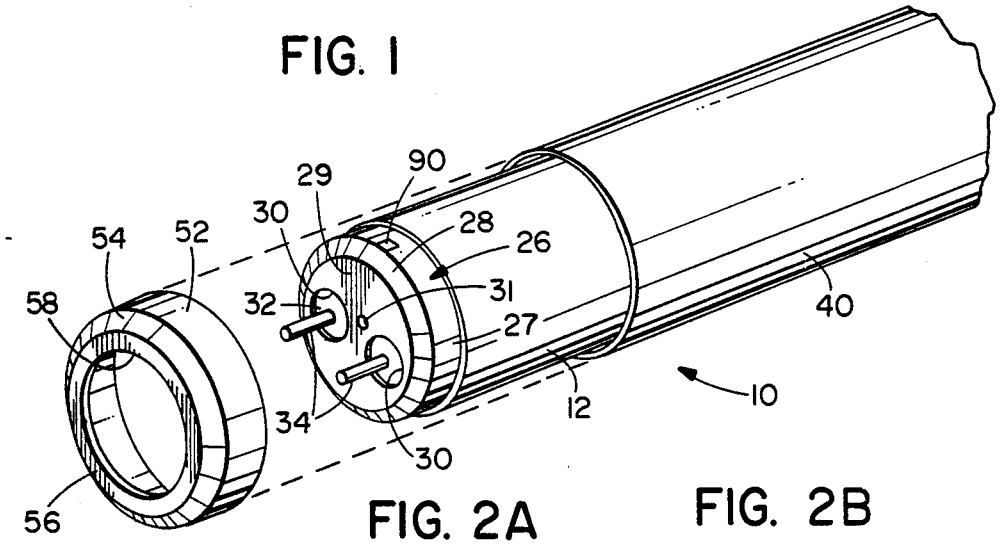
FIG. 1 is a perspective exploded view of a lamp with protective sleeve joined and sealed by adhesive in accordance with one embodiment of the invention.
Figure 2A:
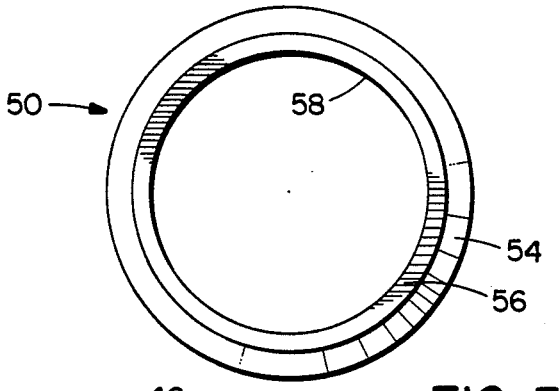
FIG. 2A is an end view of the retaining ring.
Figure 2B:
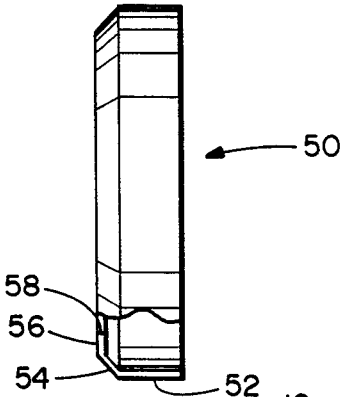
FIG. 2B is a side view of the retaining ring.
Figure 3:
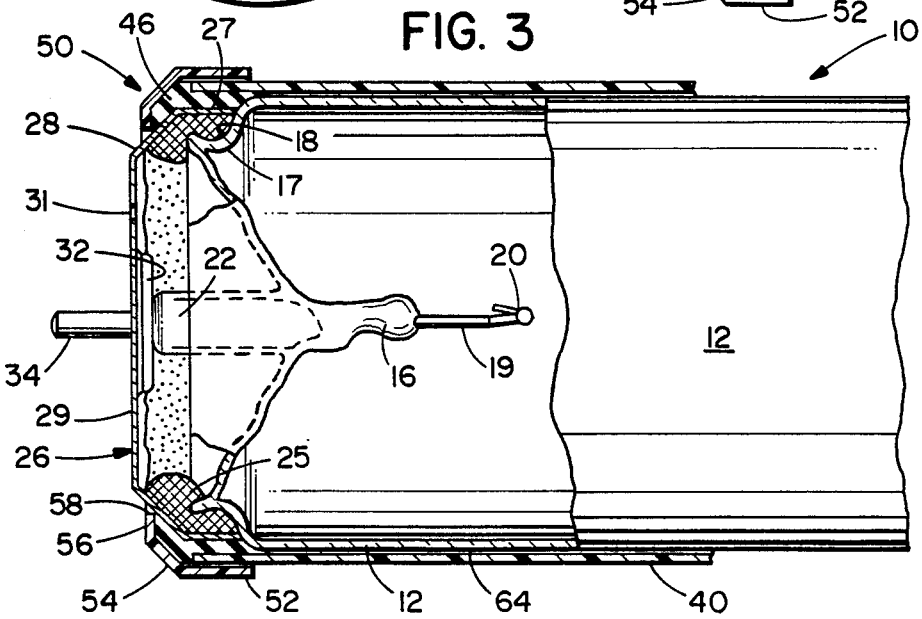
FIG. 3 is a side view of the assembled lamp showing broken away with the sleeve in place.

Referring to FIGS. 1–3, the first embodiment of the protective sleeve for a fluorescent lamp is shown. There is fluorescent lamp 10 having a standard internal construction, that is, a glass walled envelope 12 with a phosphor coated on the internal wall and a quantity of an ionizable material, such as mercury, within the envelope.

The envelope can be fully cylindrical along its length or have a helical groove along most of the length, except at the ends, such as the POWER-TWIST® lamp sold by the assignee of the subject application. As seen best in FIG. 3, each end of the envelope 12 has an internal glass stem press 16 sealed therein at a tapered end 17 with an external circumferential groove 18. An electrode 20 is mounted by a pair (only one shown) of leads 19. The leads 19 extend through the stem press 16. Reference numeral 22 is the tubulation through which the lamp is exhausted, and then filled with the necessary ionizable material and fill gas and sealed.

A base 26 is sealed to each end of the lamp by a suitable heat sensitive adhesive 25 placed in the groove 18. The base 26 is made of metal or other suitable material. As seen in each of FIGS. 1–3, the lamp base 26 has a generally cylindrical collar 27 which fits over the end of the envelope and a chamfered part 28 which extends therefrom to terminate in a flat end wall 29. The end wall has a pair of openings 30 and a vent hole 31. An insulating piece 32 (see FIG. 3) bridges the two openings 30 and supports a pair of outwardly projecting terminals 34 mounted on the insulating piece. The terminals 34 are used to mount the lamp to a socket (not shown). Each terminal 34 is connected by a lead wire (not shown) through which the stem press 16 to the leads 19 which provide the connector to the filament cathode.

The lamp structure and method of manufacturing up to this point is conventional.

The assembly also includes a plastic sleeve 40 which is of a suitable material, such as a polycarbonate. The plastic sleeve is, for example, in the range of about 0.02" to 0.10" inches in thickness and its inner diameter is slightly larger than the outer diameter of the glass lamp envelope 12. Other suitable materials and dimensions can be used for the sleeve depending upon the application. The sleeve material/thickness can be selected to have enough strength to withstand the collapsing of the lamp without the sleeve collapsing. Basically, the larger the lamp diameter, the stronger (material/thickness) must be the sleeve material. The sleeve can be somewhat extendable or fully rigid upon envelope rupture. The sleeve can be fully cylindrical with a smooth outer surface. There can be raised ridges along the majority of its length (except at the ends) to increase its strength.

As seen in FIG. 3, a quantity of a suitable adhesive 46, for example, silicone rubber, is placed between the lamp base shoulder 27 and its chamfer 28, and the end of the sleeve 40. The adhesive also adheres to the end the glass envelope. Thus, the adhesive makes an integral connection between the envelope 12, base 26, sleeve 40 and the retaining ring 50.

The assembly is completed by a retaining ring 50 which is preferably molded of a suitable plastic material, such as polyethylene, polyester, nylon, etc. The retaining ring is generally cylindrical in shape and includes a cylindrical main body wall collar 52 from which extends a chamfered wall 54 terminating in a flat ring 56 surrounding a circular aperture 58. The aperture is of a size which is larger than the flat wall 29 of the lamp base 26 and into and through which at least a part of the chamfer 28 of the lamp base extends.

The chamfer 28 on the lamp base and the chamfer 54 on the retaining ring are generally parallel. They range from about 40° to about 50° with the preferred embodiment being about 47.5°. As seen in FIG. 3, the adhesive 46 conforms to the shape of the retaining ring chamfer 54 on the inner wall thereby attaching the retaining ring to the adhesive.

To assemble the embodiment of the invention shown in FIGS. 1–3, the plastic sleeve 40 is slipped over the lamp envelope 12. The lamp base 26 with the terminals 34 already in place are on each end of the envelope 12. An amount of silicone rubber adhesive 46 is applied on top of the lamp base 26 at 27 between it and the plastic sleeve 40. As indicated previously, the sleeve has a larger inner diameter than the outer diameter of the envelope. Consequently, the sleeve is fixed into place on the silicone rubber adhesive leaving an annular air space 64 between the lamp envelope and the sleeve along the entire length of the envelope. The lamp base vent holes 31 are preferably filled with some adhesive to prevent moisture from entering into the space between the end of the envelope and the lamp base and mercury vapor from escaping from a broken lamp.

Enough adhesive 46 is applied so that it will fill the space between the lamp base 26 and the internal part of the retaining ring 50. Thereafter, the retaining ring is placed over the adhesive 46. As seen in FIG. 3, there is an excess of adhesive so that a space can be filled between the internal wall of the retaining ring collar wall 52 and the outer surface of the sleeve 40. Any excess adhesive is wiped off. The same steps are performed at the other end of the lamp. Thereafter, the ends of the lamp are finished and the assembly is permitted to cure for about 24 hours so that the adhesive 46 will firmly set and harden to the shape shown.

The embodiment of FIGS. 1–3 has a number of advantages. All of the glass, phosphor powder, mounting parts and liquid mercury of a fluorescent lamp are contained within a totally sealed system of the protective sleeve 40 and the adhesive 46 which attaches the sleeve 40 to base 26 at each end of the lamp. The overall length of the lamp is unchanged and the overall radius of the lamp with the sleeve is increased by about only 1/16 of an inch. If the lamp envelope breaks, all of the breakage is contained within the sleeve since there is a closed system of the sleeve being attached to the envelope and the base at each end of the lamp, i.e., a base will not separate from the sleeve.

There is a controlled distance between the outer surface of the glass envelope 12 and the plastic sleeve 40. If a sleeve or a coating is adhered directly to the outer glass surface of the envelope, such a sleeve must be able to withstand the concentrated stress at any fracture line of the envelope. That is, the sleeve would tend to crack at the same place that the glass envelope cracked. As plastics age, they become weaker and more brittle and on old lamps the plastic itself could crack, due to high stress upon breaking of the envelope. The controlled air space 64 prevents any stress on the glass fracture line from being transmitted to the plastic.

The retaining ring 50 can be used to compensate for normal lamp length variations. It also compensates for misaligned and tilted base variations. That is, on the final assembly of the retaining ring 50, a jig can be used which provides a square surface for the end cap relative to the sleeve. Since the retaining ring can be aligned on the adhesive, the proper alignment can be obtained even if a lamp base 26 has been tilted. The retaining ring is assembled like a segment of a ball and socket configuration upon the lamp base 26. In addition, the lamp installation into the sockets is made easier by the chamfered surface 54 of the end cap.

FIGS. 4–7 show another embodiment of the invention. Similar reference numerals are used where applicable. Here, the configuration of the lamp envelope 12 and its base 26 are the same as in FIGS. 1–3.

Figure 4:
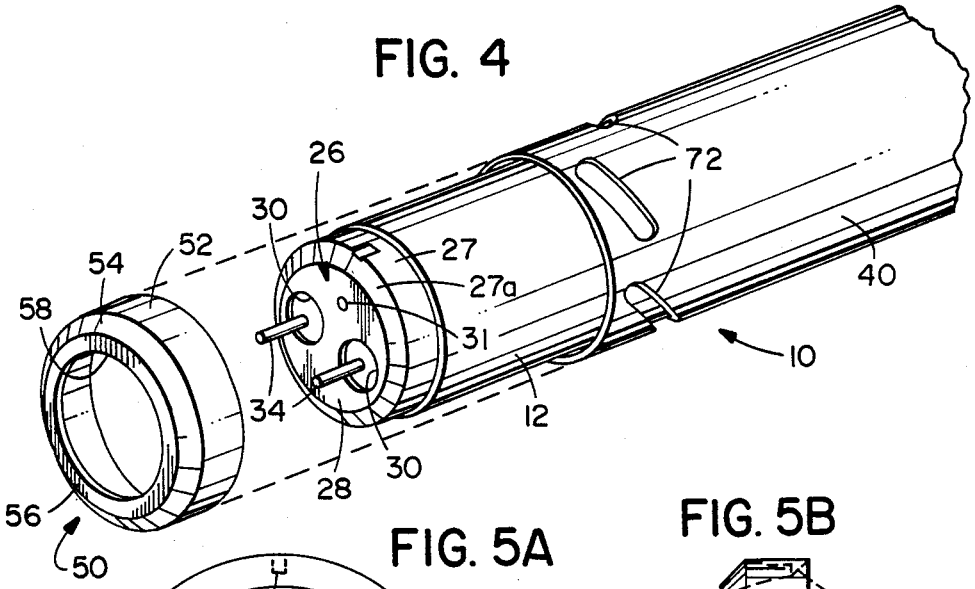
FIG. 4 is an exploded perspective view of a portion of one end of a lamp and safety protective sleeve joined mechanically and by adhesive and sealed by adhesive in accordance with another embodiment of the invention.
Figure 5A:
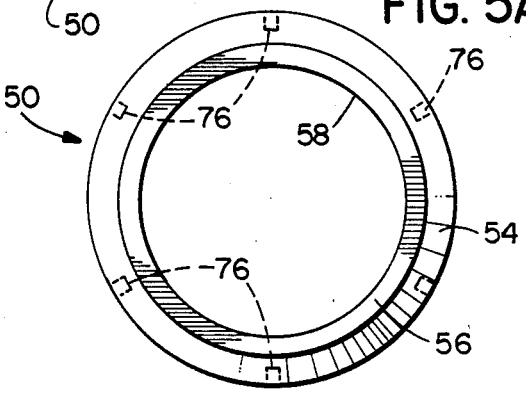
FIG. 5A is ah end plan view of the retaining ring.
Figure 5B:
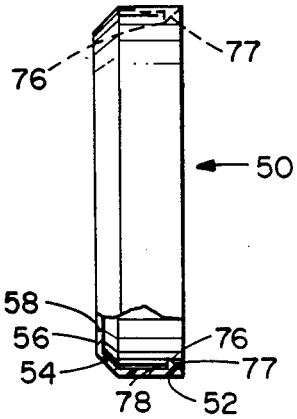
FIG. 5B is a side view of the retaining ring.
Figure 6A:
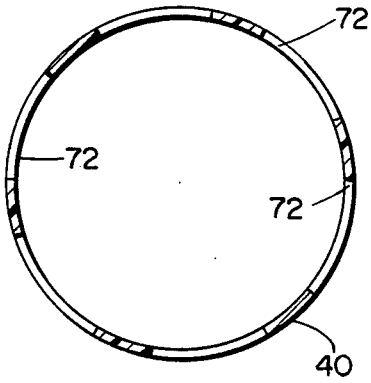
FIG. 6A is an end view of the protective sleeve.
Figure 6B:
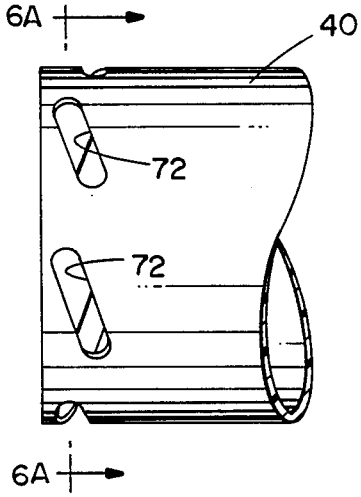
FIG. 6B is a side view of the protective sleeve.
Figure 7:
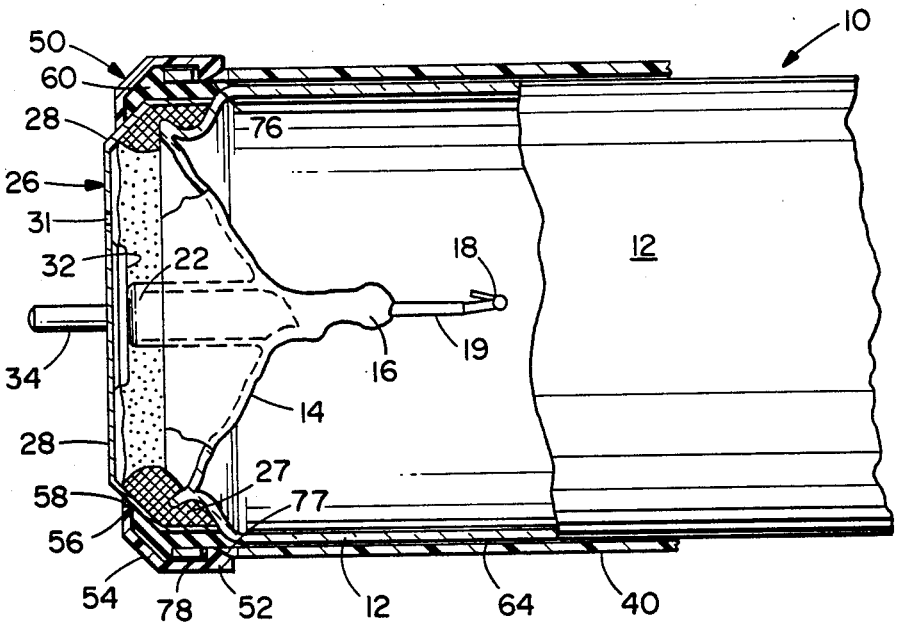
FIG. 7 is a view of the assembled lamp shown partly broken away of an end of the assembly.

As seen most clearly in FIG. 4, each end of the sleeve 40 is formed with a series of slots 72. Each slot is angled from the end of the shield by about 20°, although other suitable angles can be selected. It is preferred that each of the slots 72 extend around the lamp envelope for about 60° so that there are six of the slot 72. Of course, more or less of such slots can be used as desired.

Each of the retaining rings 50 has an outer surface configuration the same as previously described. On the inner wall of the cylindrical collar 52, a plurality of hooks 76 preferably of the same number as the slots 72, here six, are formed. The hooks shown extend to near the outer end of the cylindrical collar 52 and have an inwardly tapered surface 77 (see FIG. 5B) and thereafter turn inwardly to a substantially flat ledge 78. The tapered surface 77 and ledge 78 are configured at an angle relative to the collar 52 to correspond with the angle of the edge of the sleeve slot 72 over which the hook is to fit. Other types of locking teeth can be used.

In the assembly of the embodiment of FIGS. 4–7, the plastic sleeve 40 is prepared by forming the angled slots 72 at each end. The slots of one end are at a controlled distance from those at the other end. However, as should be apparent, because of the length of the slots and their angle of the slots from the end of the sleeve, there is an adjustable length from each end of the sleeve and between the ends of the slots 72. This is used to accommodate for any variations in the length of the lamp envelope relative to the sleeve.

To assemble the unit, the plastic sleeve 40 is slid over the lamp and the silicone adhesive 46 is inserted between the lamp base 26 and the sleeve to achieve the controlled air space 64 referred to previously and the attachment of the sleeve, base and glass envelope. The base vent holes 30 are then filled. There is enough silicone adhesive on the base so that it will contact the inner wall of the retaining ring 50, to secure the retaining ring to the base. A retaining ring 50 is then placed over an end of the sleeve and moved along the sleeve until the locking teeth 76 snap into the corresponding slots 72 on the end of the sleeve.

After this is completed at one end of the lamp, silicone adhesive is applied between the lamp base and the plastic sleeve 40 at the other end. Here also there is sufficient silicone adhesive applied between the lamp base and the sleeve 40 to fill the space when the retaining ring is finally fastened to the assembly. The retaining ring is then moved over this end of the sleeve until the teeth engage the angled slots. Thereafter one or both of the rings 50 are rotated until they lock up tight against the lamp bases. This will ensure proper length for the protective sleeve, a square alignment of the retaining rings and positive locking of the lamp-sleeve system together for handling while the adhesive is curing. This also provides for double locking of the encapsulating adhesive after curing, that is, the two retaining rings are twisted so that an amount of longitudinal stress is placed on the plastic sleeve. The stress would be relatively uniform since there are a number of points, six in the example being described, for the six teeth engaging the sleeve wall adjacent the six slots, for which there is engagement with the plastic sleeve.

The embodiment of FIGS. 4–7 functions in a similar manner to that of FIGS. 1–3 if the envelope ruptures. That is, the retaining rings are sealed to the lamp end caps via the adhesive and there is a positive coupling of the sleeve to the retaining rings by the sleeve slots 72 and the locking tabs 76 on the retaining ring. Thus, if the lamp envelope ruptures, the envelope end caps do not become detached from the sleeve.

Figure 8:
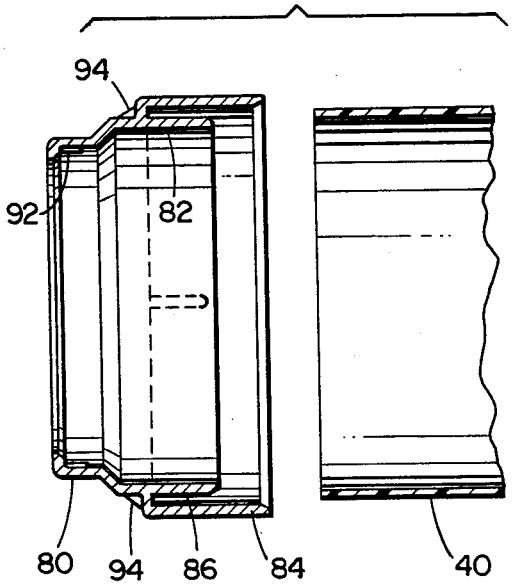
FIG. 8 is an elevational view in cross section of another form of retaining ring.
Figure 9:
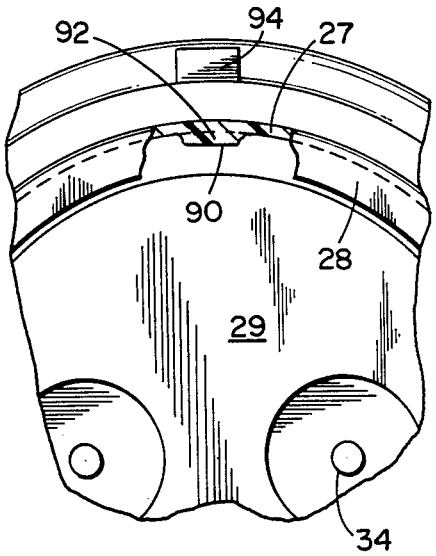
FIG. 9 is a fragmentary end view partly broken away of the retaining ring of FIG. 8.

FIGS. 8 and 9 show another embodiment of the retaining ring 80 which has a cooperating part to lock onto the lamp end up. Here, the ring collar portion which is to extend along parallel to the envelope is bifurcated to have inner and outer bands 82 and 84 leaving a space 86 therebetween. The outer band 84 is longer than the inner band 82. The end of the sleeve 40 is slipped into the space 86 between the two bands and the longer outer band 84 provides structural strength to prevent the sleeve from coming loose from the retaining rings.

This embodiment takes advantage of the orientation indents 90 (see FIG. 1) of generally rectangular configuration, which are found on the collar of the end cap of most fluorescent lamps. The two indents 90 are spaced diametrically opposite on the end cap and are used to assist a person installing a lamp in a fixture. That is most lamps have two pins and the fixture or tombstone type socket. The indents 90 are visual markers to the lamp installer which tells him to insert the lamp in the fixture in a predetermined direction. Usually, if an indent in the middle between the two entries to the terminals of the socket, then the lamp will be oriented correctly for installation into the sockets of the lamp fixture. After insertion in this manner, the lamp is rotated to lock it in the socket.

In this embodiment, the retaining ring 80 has index tabs 92 on its inner surface of a mating shape to the indents 90 on the lamp end cap. The outer surface of the retaining ring has a rib 94, as shown opposite to and in line with the index tab 92. Thus, when the retaining ring is assembled to the end cap with its index tabs 92 positioned in the indents 90 on the lamp base, there will be a visual indication on the retaining ring to assist the installer to orient the lamp correctly. As should be apparent the orientation marker on the outer surface of the retaining ring can be a groove, or printed mark.

The assembly of the lamp using the retaining ring 80 is similar to that previously described. It is carried out one end at a time. Adhesive is applied to the lamp end cap and retaining ring is placed on the end cap. The ring is rotated until its index tabs 92 lock into the indents 90 on the end cap. The sleeve inserted into the space 86 in the ring between the two bands 82, 84 and the ring held in place by the adhesive 46. Thereafter, a ring 80 at the other end of the lamp is placed so that the other end of the sleeve fits into the space 86 between its two bands 82, 84. This ring is also rotated so that its index tabs lock into the lamp base indents 90. Adhesive can be applied in the space 86 of each of the rings if desired since this makes a composite assembly of the retaining rings and the sleeve. The adhesive is not totally necessary. The space 86 between the two bands provides for an adjustment to compensate for sleeve 40 of slightly different lengths.

As in the embodiments of FIGS. 8–9, if the envelope breaks, the connection between the lamp end caps and the sleeve via the retaining rings is still retained.

As can be seen, a shatter proof fluorescent lamp is provided in which the plastic protective sleeve is spaced from the lamp envelope so that there is no direct transmission of stresses in the envelope glass to the sleeve. In addition, the arrangement permits easy insertion of the complete lamp with protective sleeve into the sockets of the fixture and there is a firm locking and assembly of the plastic sleeve to the lamp base and envelope at each end of the lamp.

In the embodiments of FIGS. 8 an 9, the mating retaining ring index tab 92 and lamp base indent 90 provide positive engagement between the retaining ring and the lamp base. The sleeve can have some longitudinal length tolerance because of the length of the retaining ring space 86 along the lamp axis. All of the features of integrity between the retaining ring, lamp base and envelope and air space between the lamp and the envelope are retained.

What is claimed is:

1. A shatterproof fluorescent lamp comprising:

an elongated glass envelope having an ionizable medium therein to interact with a phosphor coating on the envelope inner wall and an electrode at each end of the envelope;

a base on each end of the lamp having a collar which fits over the end of the envelope;

a protective sleeve having an inner diameter larger than the outer diameter of the envelope for fitting over the envelope; and adhesive means at each end of the envelope for connecting the base, envelope and sleeve for mounting the sleeve relative to the envelope to provide an air space between the outer surface of the envelope and the inner surface of the sleeve, said adhesive mounting means holding the lamp base attached to the sleeve upon breakage of the envelope.

2. A lamp a in claim 1, further comprising a retaining ring having a portion extending over the corresponding end of the sleeve and being adhered to the adhesive.

3. A lamp as in claim 2 wherein said retaining ring has a collar which extends over the lamp base and from which extends a chamfered wall portion.

4. A lamp as in claim 2 wherein a plurality of spaced angled slots are formed adjacent an end of the sleeve around its circumference, a said retaining ring having formed thereon a plurality of locking means corresponding to the slots on said sleeve.

5. A lamp as in claim 4 wherein there are a plurality of angled slots on each end of the sleeve and corresponding locking means on each retaining ring.

6. A lamp as in claim 1 wherein the sleeve is rigid enough to withstand collapse upon breakage of the lamp envelope.

7. A lamp as in claim 2 wherein said retaining ring has a pair of bands with a space therebetween surrounding the end of the envelope, the end of the sleeve fitting within said space.

8. A lamp as in claim 7 wherein the outer band is longer than the inner band.

9. A lamp as in claim 2 wherein the lamp base has a physical orientation means thereon, and means on the retaining ring mating with said orientation means to form a mechanical lock.

10. A lamp as in claim 9 wherein said base orientation means comprises an indent and said mating means on said retaining ring comprises an index tab which fits into the index.

11. A lamp as in claim 9 further comprising orientation means on the outer surface of said retaining ring generally in-line with the means on the inner surface which mate with said lamp base orientation means.

12. A lamp as in claim 10 further comprising orientation means on the outer surface of said retaining ring generally in-line with the index tab on the inner surface of the retaining ring.

13. A lamp as in claim 1 wherein the protective sleeve has an overall length less than the overall length of the envelope and the attached base and the mounting mean terminate within the length of the bas at each end of the envelope.

14. A shatterproof fluorescent lamp comprising:

an elongated glass envelope having an ionizable medium therein to interact with a phosphor coating on the envelope inner wall and an electrode at each end of the envelope;

a base on each of the lamp having a collar which fits over the end of the envelope;

a protective sleeve having an inner diameter larger than the outer diameter of the envelope for fitting over the envelope and having a length less than the overall length of the envelope and the attached bases; and adhesive mounting means terminating within the length of the base at each end of the envelope which connects the base, envelope and sleeve for mounting the sleeve relative to the envelope with an air space between the outer surface of the envelope and the inner surface of the sleeve, said adhesive mounting means holding the lamp base attached to the sleeve upon breakage of the envelope.

15. A lamp as in claim 14, wherein said mounting means further comprises a retaining ring at each end of the envelope having a portion extending over the corresponding end of the sleeve having an inner portion which is adhered to the adhesive.

16. A lamp as in claim 15 wherein said retaining ring has a collar which extends over and within the length of the lamp base and from which extends a chamfered wall portion.

* * * * *